US010208484B1

(12) United States Patent
Simonsen

(10) Patent No.: US 10,208,484 B1
(45) Date of Patent: Feb. 19, 2019

(54) APPARATUS FOR MOUNTING A PANEL TO A FACADE

(71) Applicant: David Simonsen, Redding, CA (US)

(72) Inventor: David Simonsen, Redding, CA (US)

( * ) Notice: Subject to any disclaimer, the term of this patent is extended or adjusted under 35 U.S.C. 154(b) by 0 days.

(21) Appl. No.: 15/285,937

(22) Filed: Oct. 5, 2016

(51) Int. Cl.
*E04F 13/08* (2006.01)

(52) U.S. Cl.
CPC ..... *E04F 13/0816* (2013.01)

(58) Field of Classification Search
CPC ..... E04F 13/0816; E04F 13/0889
USPC ..... 52/235, 506.01, 506.05, 506.06, 506.08, 52/506.09, 509, 510
See application file for complete search history.

(56) References Cited

U.S. PATENT DOCUMENTS 1,997,581 A * 4/1935 Heeren ..... E04B 9/26 248/228.7
4,650,702 A * 3/1987 Whitmyer ..... E04B 2/92 428/31
4,738,065 A * 4/1988 Crandell ..... E06B 3/5427 52/235
5,212,922 A * 5/1993 Werner ..... E04B 2/967 52/208
5,644,878 A * 7/1997 Wehrmann ..... E04B 2/7457 52/235
7,562,504 B2 * 7/2009 Herbst ..... E04F 13/0889 52/235
7,661,237 B2 * 2/2010 Jakob-Bamberg .... E04B 2/7448 52/235
7,716,891 B2 * 5/2010 Radford ..... E04F 13/0805 52/235
8,096,089 B2 * 1/2012 Platt ..... E04B 9/0414 52/316
8,127,507 B1 * 3/2012 Bilge ..... E04F 13/0814 52/235
8,166,716 B2 * 5/2012 Macdonald ..... E04F 13/0826 52/235
8,240,099 B2 * 8/2012 Hummel, III ..... E04F 13/0892 52/235
8,745,941 B2 * 6/2014 Macdonald ..... E04F 13/0825 52/235
9,091,079 B2 * 7/2015 Wright ..... E04F 13/0816
9,464,441 B2 * 10/2016 Wright ..... E04F 13/0816
9,482,006 B2 * 11/2016 Koetje ..... E04F 13/0846
2002/0152704 A1 * 10/2002 Thompson ..... E04B 9/245 52/506.06
2009/0145071 A1 * 6/2009 Radford ..... E04F 13/0805 52/506.08
2009/0241451 A1 * 10/2009 Griffiths ..... E04F 13/081 52/309.4
2010/0037549 A1 * 2/2010 Lynch ..... E04F 13/0889 52/506.08
2010/0263314 A1 * 10/2010 MacDonald ..... E04F 13/0826 52/506.05
2012/0017530 A1 * 1/2012 Hummel, III ..... E04F 13/081 52/506.05
2012/0096799 A1 * 4/2012 Wright ..... E04F 13/0816 52/578

(Continued)

*Primary Examiner* — Brent W Herring
(74) *Attorney, Agent, or Firm* — Theodore J. Bielen, Jr.

(57) ABSTRACT

An apparatus for mounting a panel to a façade utilizing a base member fastened to such façade. The base member provides a compartment holding a bracket that mates with a receiver. The receiver links to the panel via an extension member held to the panel.

8 Claims, 9 Drawing Sheets

(56) References Cited

U.S. PATENT DOCUMENTS

| | | | | |
|---|---|---|---|---|
| 2015/0121794 | A1* | 5/2015 | Koetje | E04F 13/0846 52/506.05 |
| 2015/0184372 | A1* | 7/2015 | Wright | E04F 13/0816 52/698 |
| 2015/0284951 | A1* | 10/2015 | Frederick | E04B 2/965 52/235 |

* cited by examiner

APPARATUS FOR MOUNTING A PANEL TO A FACADE

CROSS-REFERENCES TO RELATED APPLICATIONS

The present application is a continuation-in-part of U.S. patent application Ser. No. 15/048,842, filed 19 Feb. 2016.

BACKGROUND OF THE INVENTION

The present invention relates to a novel and useful system for mounting panels to a façade found on building structures and the like.

Panels are often used on residential and commercial buildings to cover walls or facades since they have proved to be economical, protective of the edifice, and exhibit a high degree of design versatility, when compared to other coverings.

In the past, panel systems have been employed that are categorized as "progressive style systems". That is to say, that the panels are installed progressively from left to right on the bottom row of a building façade and then upwardly one row at a time in the same direction. The disadvantage of a progressive style panel system is that if a single panel must be removed, many other panels must also be removed prior to gaining access to such single panel.

In the past, many systems for mounting wall panels to a surface have been proposed. For example, U.S. Pat. No. 6,588,165 shows an extrusion device for mounting a wall panel that utilizes a base having receiver flanges that accept a clip that snaps into a channel and includes arms that extend over the top of the panel.

United States Patent Application Publication 212/0304573 describes a panel clip structure which is attached the backside of the panel and is attached to horizontal joints through a tongue and groove system. A plurality of horizontal caps then keeps a single panel from being easily removed without repositioning adjacent panels on the façade.

United States Patent Application Publication 2006/0080939 features a wall panel system that utilizes a plurality of furring strips that are used to fasten panels via fasteners extending through grooves formed in the panel itself.

U.S. Pat. No. 6,688,056 describes a demountable wall panel system that utilizes vertical posts, a panel covering, a sealing rail, and an articulating floor channel. A support frame is formed and operatively connected to the articulating floor channel, which is used to secure the frame to a ground surface.

U.S. Pat. No. 7,752,818 shows a self-leveling clip which is fixed to the façade and holds a panel by the use of a retentive clip that is engaged by a self-drilling screw between adjacent panels.

An apparatus for mounting a plurality of panels to a façade in a non-progressive manner, efficiently and economically, would be a notable advance in the building industry.

SUMMARY OF THE INVENTION

In accordance with the present application, a novel and useful apparatus for mounting panels to a façade in a non-progressive manner is herein described.

The apparatus of the present application utilizes a base or field extrusion having a plate and first and second flanges extending outwardly from the plate. The first and second flanges form an open channel which extends along the plate. Each of the first and second flanges is formed with a resilient leg that extends inwardly toward the channel. The base is held to the façade by a fixing element such as a plurality of screws, rivets, and the like.

An extension element or frame extrusion is connected to each of the panels to be mounted to the façade. Each extension element is formed with a platform that is supported by the plate of the base. Platforms on adjacent extension elements connected to adjacent panels are positioned apart from one another and away from the faces of the first and second panels.

A fastener is utilized to interconnect adjacent panels. Such fastener is fashioned with a basal portion and first and second arms projecting from the basal portion. The basal portion also is formed with pair of inclined surfaces that are angled relative to the plate. Likewise, the pair of arms extending from the basal portion each includes contact surfaces for engaging the platforms found on the extension elements of adjacent panels. The pair of inclined surfaces of the basal portion of the fastener is dimensioned to slide on a pair of resilient legs of the flanges extending from the plate of the base. Such sliding takes place upon the rotation of the basal portion of the fastener within the channel of the base resulting in a force being exerted on the resilient legs of the flanges. Such force forces the contact surfaces of the pair of arms of the fastener to firmly press downwardly on the platforms of the extension elements connected to adjacent panels and, thus, hold the adjacent panels to the façade.

The extension element may also be formed with a slot such that adjacent extension elements connected to adjacent panels allow the insertion of a strip that essentially occupies the space or reveal between panels. The extension element may also be employed to hold corner brackets between panels.

A stiffener may also be used in adjacent panels and be at least partially supported by a shelf connected to extension elements found in adjacent panels. Stiffeners provide support to the panels in order to prevent deflection and cracking of the panel.

Another embodiment of the present application utilizes base member connected to a façade. The base member possesses a bracket extending outwardly from the base member to form a first compartment. A receiver is located in the first compartment and is free to slide along the first surface. An arm extends from the receiver and engages an extension member fixed to a first panel. The bracket is also formed with a support that allows the positioning of a reveal strip. A second compartment is also formed in the base member to mount a second panel. The second compartment houses a bracket, receiver, and extension member similar to that associated with the first compartment. A support of the bracket of the second compartment serves to position the reveal strip in conjunction with the support of the bracket of the first compartment.

In addition, the extension elements may be located at various distances from the face of the panel to the base, thus, adjusting the depth of the space between panels as may be architecturally specified.

It may be apparent that a novel and useful apparatus for fabricating and mounting panels to a facade has been here and above described.

It is therefore an object of the present application to provide apparatus for fabricating and mounting a plurality of panels to a façade which results in the mounting of panels in a non-progressive manner.

Another object of the present application is to provide an apparatus for fabricating and mounting a plurality of panels to a façade that is capable of being installed quickly and efficiently by the use of a manually operated fastener.

Another object of the present application is to provide an apparatus for fabricating and mounting a plurality of panels to a façade in which the reveal between panels includes an adjustable depth or distance between the façade and the panel.

Yet another object of the present application is to provide an apparatus for fabricating and mounting a plurality of panels to a façade that is durable and reliable in operation.

Another object of the present application is to provide an apparatus for fabricating and mounting a plurality of panels to a façade that allows the installation of panels more quickly than prior art systems.

Yet another object of the present application is to provide an apparatus for fabricating and mounting a plurality of panels to a façade that provides for the creation of different reveal styles, multiple panel depth options, and can be used with panels formed of plate or composite material.

Another object of the present application is to provide an apparatus for fabricating and mounting a plurality of panels to a façade that exhibits a shape that meets strict hurricane requirements.

Yet another object of the present application is to provide an apparatus for fabricating and mounting a plurality of panels to a façade that utilizes a field extrusion or base that may be employed as a field measuring device for subsequently installed panels.

Another object of the present invention is to provide an apparatus for mounting a panel to a façade that includes a mechanism allowing a snap-in procedure during installation.

The application possesses other objects and advantages, especially as concerns particular characteristics and features thereof which will become apparent as the specification continues.

Various aspects of the present application will further be apparent reviewing the following drawings of the invention.

For a better understanding of the invention references made to the following detailed description of the preferred embodiments thereof which we reference to the prior described drawings.

DETAILED DESCRIPTION OF THE PREFERRED EMBODIMENTS OF THE INVENTION

The apparatus as a whole is shown in the prior described drawings. Many aspects of the present apparatus, which are being sought for patenting, may evolve from the following detailed description of the preferred embodiments thereof which should be referenced to such prior described drawings.

Figure 1:
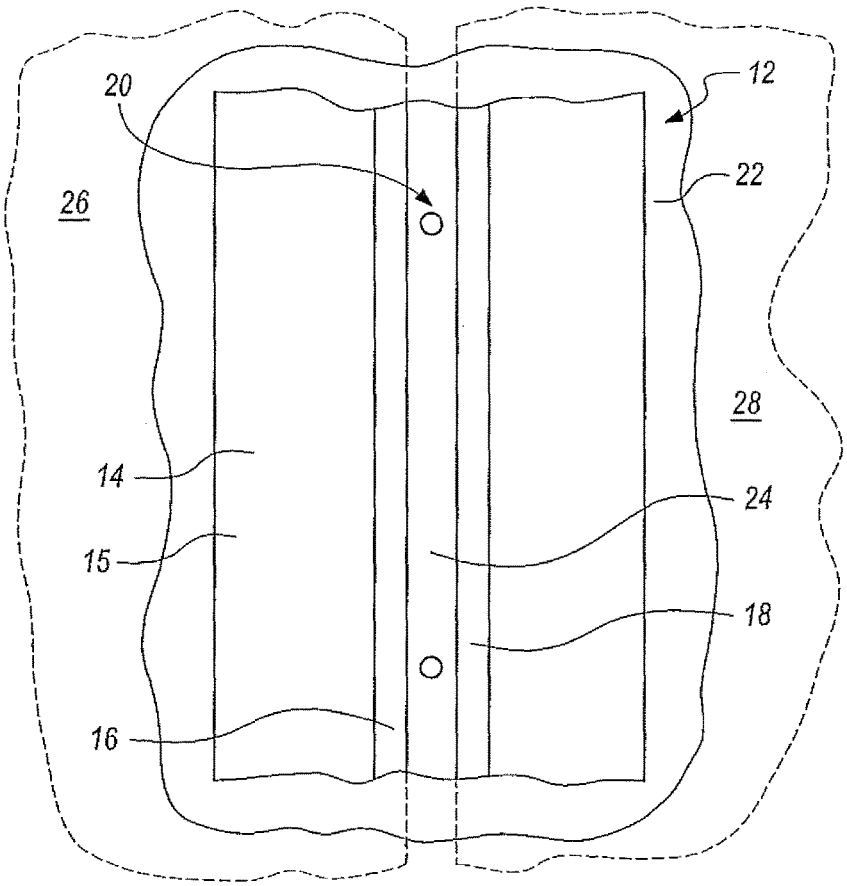
FIG. 1 is a top partial plan view of the basic element of the present invention adjacent a pair of panels.
Figure 5:
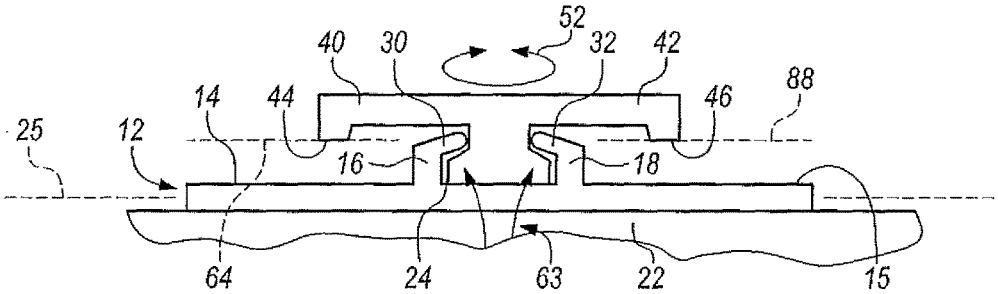
FIG. 5 is a side elevational view of the fastener and base portions of the apparatus of the present invention shown in FIG. 4.

An apparatus for mounting a plurality of panels to a façade is depicted in the drawings by reference character 10, with variation noted by the addition of an uppercase letter. Apparatus 10 includes as one of its elements a base or field extrusion 12. Base 12 possesses a plate 14, having surface 15, and first and second flanges 16 and 18 that extend outwardly from plate 14, best shown in FIGS. 1 and 5. A fixing element 20, which may take the form of a plurality of rivets, screws, and the like, holds base 12 to façade 22 which may be the side of a building or edifice. Flanges 16 and 18 form a channel 24 therebetween. In the assembled state of apparatus 10, which will be discussed in detail as the specification continues, channel 24 separates adjacent exemplary panels 26 and 28, shown in phantom on FIG. 1. Plate 14 may be positioned relative to a plane 25, FIG. 5. With further reference to FIG. 5, it may be observed that flanges 16 and 18 include resilient legs 30 and 32, respectively. Resilient legs 30 and 32 extend toward one another and toward channel 24.

Figure 2:
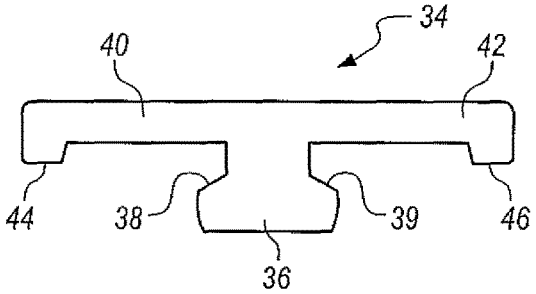
FIG. 2 is a side elevational view of the fastener employed with the apparatus of the present invention.
Figure 3:
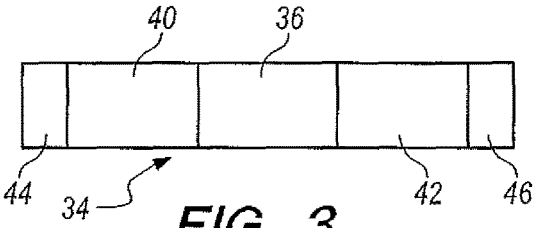
FIG. 3 is a bottom plan view of the fastener FIG. 2.
Figure 4:
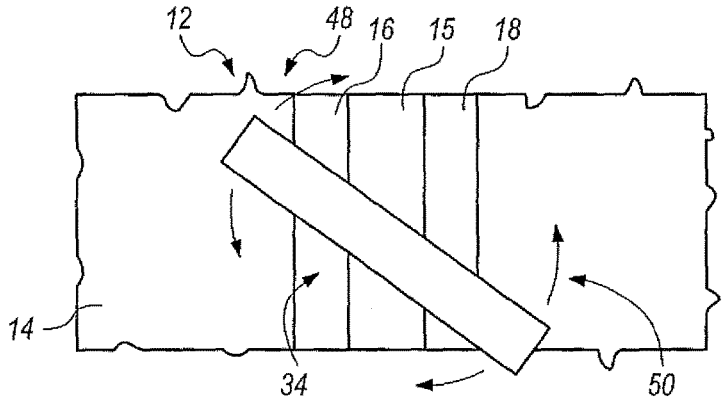
FIG. 4 is a top plan view of the fastener of FIGS. 2 and 3 being employed with the base adjacent a pair of panels.

Turning now to FIGS. 2 and 3, it may be observed that fastener 34 is depicted. Fastener 34 may be formed of any rigid or semi-rigid material, such as plastic, metal, wood, and the like. Fastener 34 includes a basal or bottom portion 36 having inclined or slanted surfaces 38 and 40. Inclined surfaces 38 and 39 are angled relative to plane 25 of plate 14 when fastener is in place in the assembled apparatus, FIG. 7, which will be detailed hereinafter. Fastener 34 is also fashioned with first and second arms 40 and 42. Arms 40 and 42 terminate in contact surfaces 44 and 46. As shown in FIGS. 4 and 5, fastener 34 is capable of rotating on surface 15 within channel 24 formed by flanges 16 and 18 extending from plate 14 of base 12 according to directional arrows 48 and 50 of FIG. 4 and directional arrow 52 of FIG. 5. Fastener 34 may also be held at channel 24 by a pop rivet, screw, rivet nut, or bolt extending through fastener 34 and plate 14.

Figure 6:
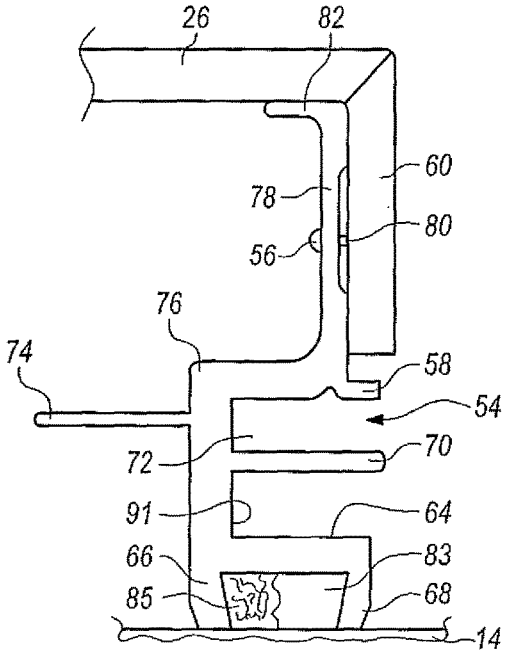
FIG. 6 is a side elevational view of an extension element used in conjunction with a single panel.

With further reference to FIG. 6 it may be seen that another part of apparatus 10 is depicted in the form of an extension element or frame extrusion 54. Extension element 54 is depicted as being connected to first panel 26 via a rivet 56. Specifically, first extension element 54 is fixed to return 60 which is either integrally formed with panel 26 or attached thereto. Return 60 may also be non-orthogonally angled relative to panel 26. First extension element 54 is similar to second extension element 62, depicted in FIG. 7, which will be discussed hereinafter. First extension element 54 includes a platform 64 supported above feet 66 and 68. Feet 66 and 68 lie on plate 14 of base 12 when apparatus 10 is assembled, FIG. 7. Cavity or space 83 between feet 66 and 68 may accept gasket material 85 (shown partially in FIG. 6) to resist water intrusion behind panels 26 and 28. Gasket material 85 will slide with exemplar extension element 54 upon the thermal expansion and contraction of panel 26. In addition, first extrusion element 54 includes a projection 70 that forms a slot 72. Moreover, a shelf 74 also extends outwardly from the body 76 of first extrusion element 54. Legs 78 of first extrusion element 54, which is shown as fixed to panel 26, forms a compression recess 80 between legs 78 and return 60. Stop 82 lies at the terminus of legs 78 and is intended to contact panel 26 to serve as a gauge to determine the distance between panel 26 and platform 64. A flange 58 projects from extrusion element 54 and may serve as a rest for a panel return longer than panel return 60. Thus, the depth between panels 24 and 26 and façade 22 may be adjusted.

Figure 7:
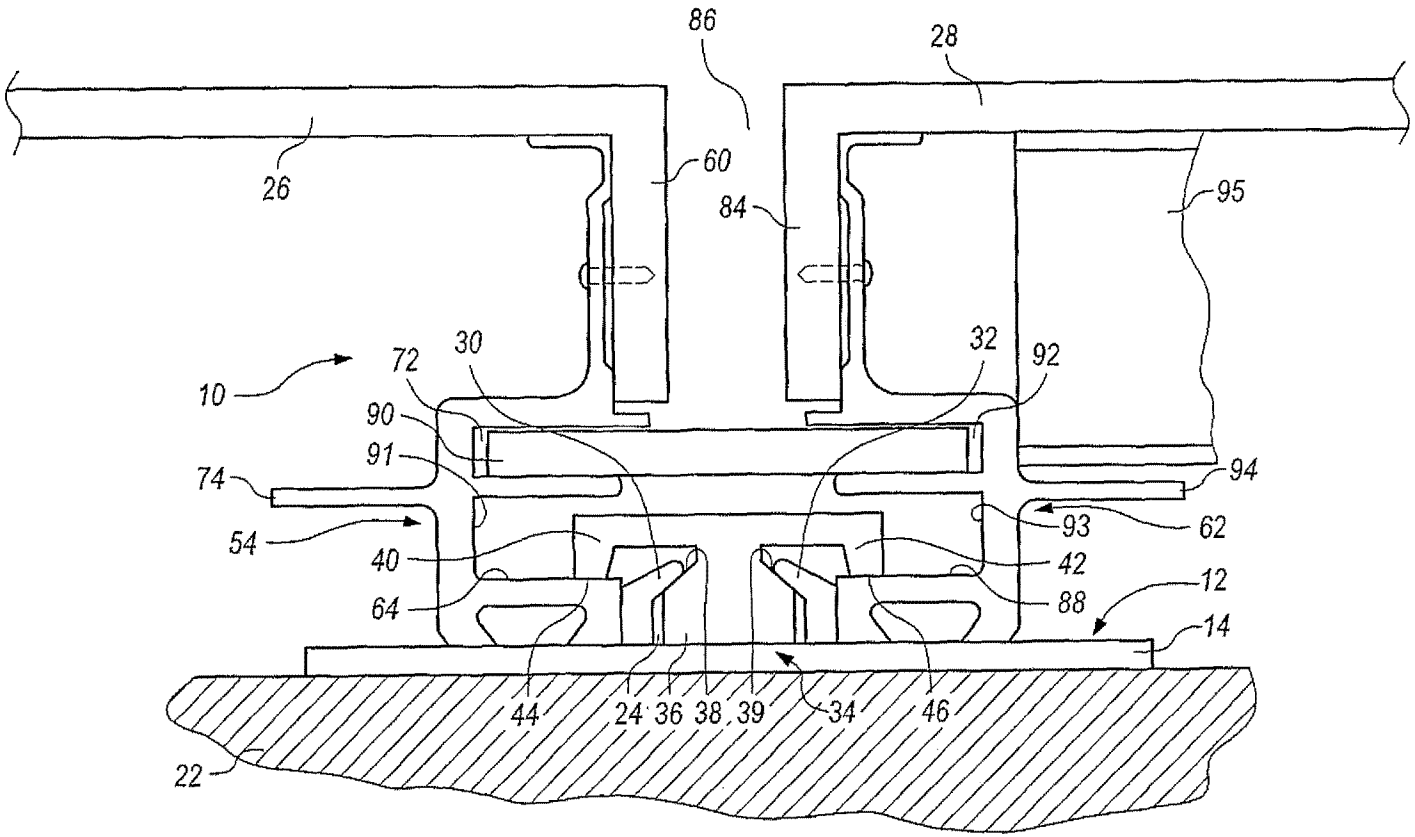
FIG. 7 is a side elevational view of a pair of panels, each having an extension element and a fastener holding such panels to the base.

Viewing now FIG. 7, it may be apparent that apparatus 10 has been assembled to hold panels 26 and 28 to façade 22. That is to say, first panel 26 having extension element 54 connected thereto has been placed on plate 14 of base 12. Likewise, panel 28 having extension element 62 attached to connected return 84 also lies atop plate 14 of base 12. Panels 26 and 28 are positioned in spaced relationship to one another such that a gap or reveal 86 is formed between returns 60 and 84 of panels 26 and 28, respectively. Fastener 34 has been rotated or twisted into place such that contact surfaces 44 and 46 of arms 40 and 42, respectively, lie over and press firmly against or position atop platform 64 of first extension element 54 and platform 88 of second extension element 62. That is to say, a slight gap may exist between contact surfaces 44 and 46 and platforms 64 and 88, respectively. In this regard, incline surfaces 38 and 39 of fastener are forced against resilient legs 30 and 32 of flanges 16 and 18 (force arrows 63) such that fastener 34 is wedged into channel 24 between flanges 16 and 18. At the same time, contact surfaces 44 and 46 press firmly against or lie over platforms 64 and 88, respectively. By this action, panels 26 and 28 are held in place on façade 22 as shown in FIG. 7. Arms 40 and 42 of fastener 34 may be lengthened from the image of FIG. 7 to lie near or against the walls 91 and 93 of extension elements 54 and 62, respectively. It should also be noted that a strip 90 has been inserted into slots 72 and 92 of first and second extension elements 54 and 62 respectively. Strip 90 serves an aesthetic purpose and is additionally employed to resist water leakage toward plate 14 of base 12. Shelf 94 of second extension element 62 is shown as supporting a stiffener 95 which contacts the underside of panel 28 and provides support thereto. Shelf 74 of first extension element may also provide accommodation for corner bracket 126, discussed hereinafter.

Figure 8:
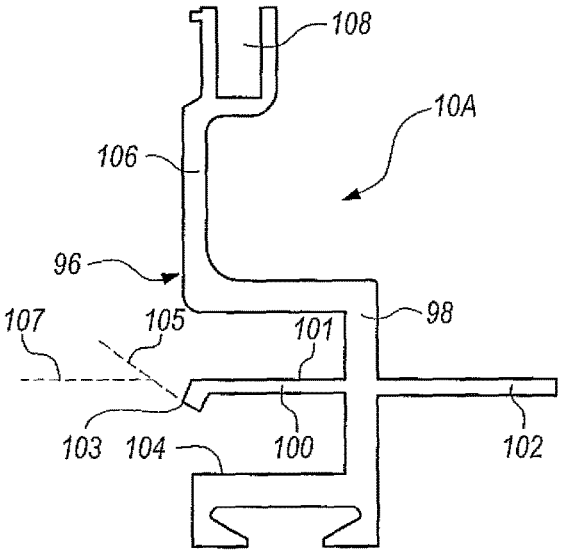
FIG. 8 is a side elevational view of another embodiment of extension element used with the apparatus of the present invention.
Figure 9:
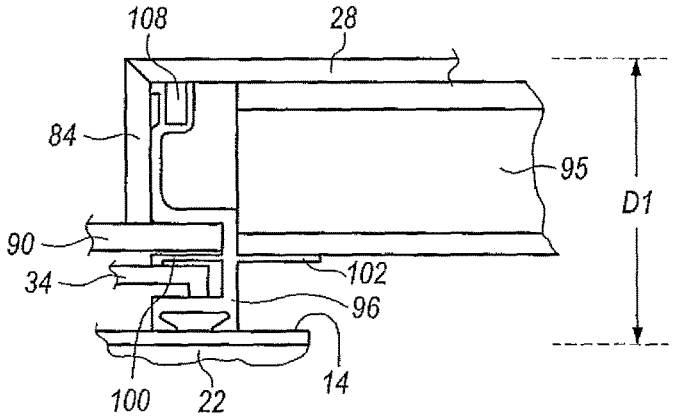
FIG. 9 is a side elevational view of the extension element of FIG. 8 used in conjunction with a single panel having a stiffener and the fastener element partially shown.
Figure 10:
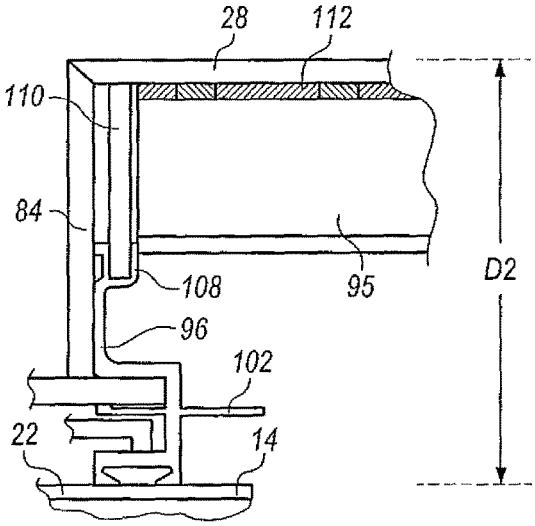
FIG. 10 is a side elevational view of the extension element of FIG. 8 employed with a filler member creating the mounting of a panel having a greater depth than shown in FIG. 9.

With further reference to FIGS. 8 through 10, another embodiment 10A of the present invention is shown with a variation of extension elements 54 and 62. Namely, extension element 96 is illustrated having a body portion 98, projection 100 with surface 101, shelf 102, and platform 104. Projection 100 includes a sloped end surface 103 that lies along a plane 105 that intersects plane 107 across surface 101. In addition, a leg 106 terminates in a notch 108. Extension element 96 is useful in adjusting the depth between the supported panel and the base fixed to the façade. For example, FIG. 9 shows panel 28 being fixed to extension element 96. Shelf 102 is used to support stiffener 95 and as an alignment for return leg 84. Shelf 102 also adds rigidity to extension element 96. Shelf 102 also gauges the size of stiffener 95, FIG. 9, as well as adding structural rigidity to extension element 96. Strip 90, fastener 34, and the similar components shown in extension element 62 are partially illustrated in FIG. 9. Projection 100 presses against strip 90 forcing strip 90 along return 84. Moisture is at least partially repelled from entry behind panel 28, by this expedient. Notch 108 rests against the underside of panel 28. Thus, the distance between the top of plate 14 and panel 28 is shown as distance "D1".

Turning to FIG. 10, it may be observed that extension element 96 has been moved downwardly toward plate 14 such that notch 108 lies a certain distance from panel 28. A filler member 110 has been placed in notch 108 between panel 28 and notch 108 in this regard. Filler member 110 serves as a gauge or measuring device during fabrication of panel 28 and return leg 60. Thus, the distance between panel 28 and plate 14 is indicated as distance "D2" which is greater than "D1" of FIG. 9. In other words, the depth or distance between panel 28 and plate 14 and façade 22 is adjustable. Notch 108 may also be filled with material to further raise panel 28. However, stiffener 95 must now be fastened to the underside of panel 28 by the use of mastic layer 112.

Stiffener 95, FIGS. 9 and 10, may be attached mechanically to shelf 102 by crimping and the like. Stiffener may also be caulked to the underside of panel 28. Such caulking ideally takes place after painting and oven curing of exemplary extension element 96 and attached stiffener 95. Again, stiffener 95, being sized to sandwich between shelf 102 and panel 28, resists twisting under exerted forces and add rigidity to panel 28.

Figure 11:
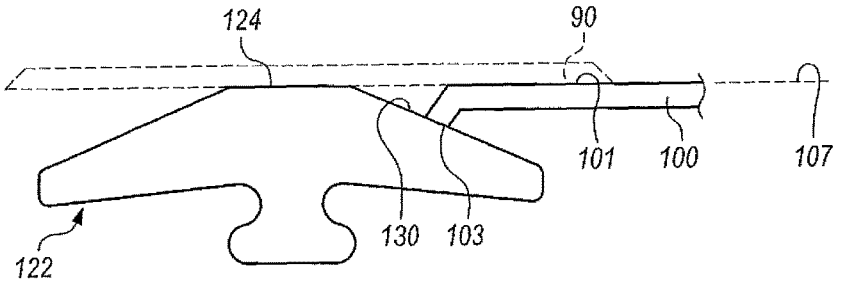
FIG. 11 is a side elevational view of an alternative embodiment of a fastener which may be employed with the extension element of FIG. 8.

Further, a fastener 122, FIG. 11, may be employed with extension element 96, in substitution for fastener 34 (FIG. 7), such that strip 90 in reveal 86 is capable of riding on the raised top surface or boundary 124 of fastener 122, and into slots 72 and 92 of extension elements 54 and 62, since surface 124 is about the same level as plane 107 of surface 101 of projection 100. It should also be seen that sloped end surface 103 rides on angled side surface 130 of fastener 124. Sloped end surface 103 may also be placed over surface 130 leaving a gap therebetween. When fastener 124 is twisted into contact with platforms 64 and 88 of extension elements 54 and 62, respectively, projection 100 presses tightly against strip 90 and the walls of slot 92, FIG. 7. Such snug fitting helps prevent water from entering beneath panel 28. Of course the same would hold true with respect to slot 72 of extension 54.

Figure 12:
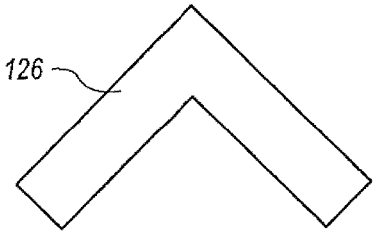
FIG. 12 is a top plan view of a corner bracket 126 used with a pair of extension elements of FIG. 8.
Figure 13:
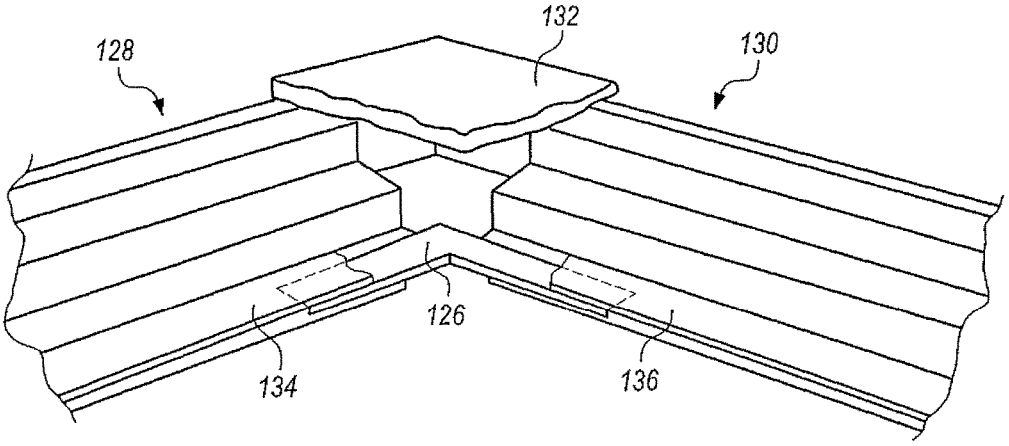
FIG. 13 is an isometric view of corner bracket 126 used with a pair of extension elements shown in FIG. 8.

Looking at FIGS. 12 and 13, a corner bracket 126, in the form of an "L" shaped member is illustrated. Corner bracket adjoins extension elements 128 and 130 below panel 132

(partially shown). Corner bracket is fixed to extension elements 128 and 130 via a mechanized fastening.

Corner bracket 126 is fastened to the underside of shelves 134 and 136 of extension elements 128 and 130, respectively, by crimping or the like. Shelves 134 and 136 are similar to shelf 102 of FIGS. 8-10. Thus, adjacent panels mounted to façade 22 are formed into a contiguous rigid frame via the use of corner brackets similar to corner bracket 126. In other words, all panels mounted to façade 22 by apparatus 10 are accurately aligned.

Figure 14:
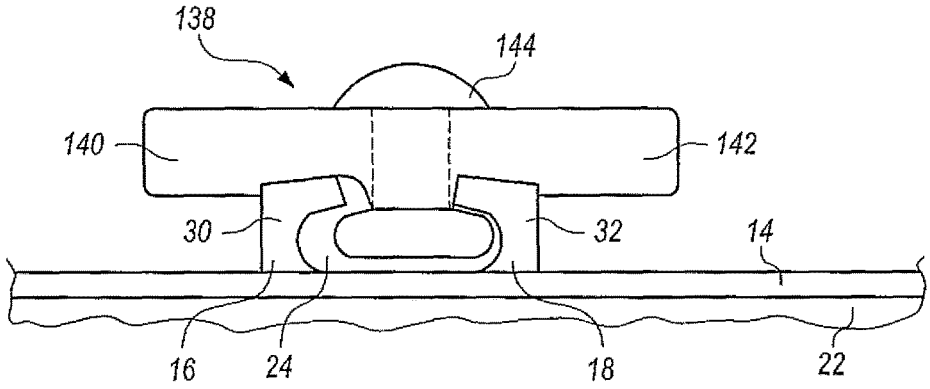
FIG. 14 is a side elevational view of another embodiment of a fastener in place on the base A.
Figure 15:
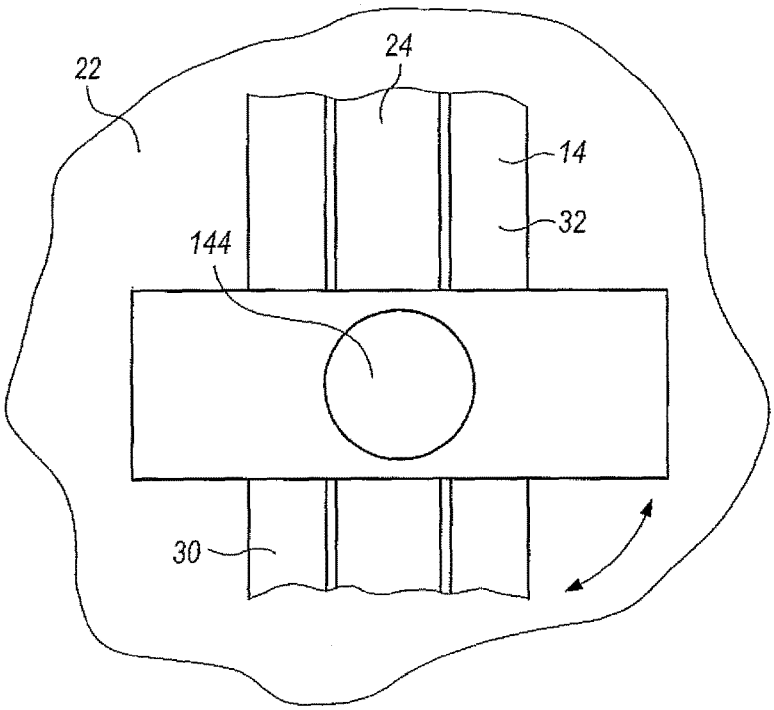
FIG. 15 is a top plan view of the elements shown in FIG. 14.

With reference to FIGS. 14 and 15, another fastener 138 is shown that may be substituted for fastener 34 or fastener 122 in apparatus 10. Fastener 34 includes arms 138 and 140 that function similarly to arms 40 and 42 of fastener 34. A shaft such as rivet 144 passes through fastener 138 and bears on resilient legs 30 and 32 of flanges 16 and 18.

Figure 17:
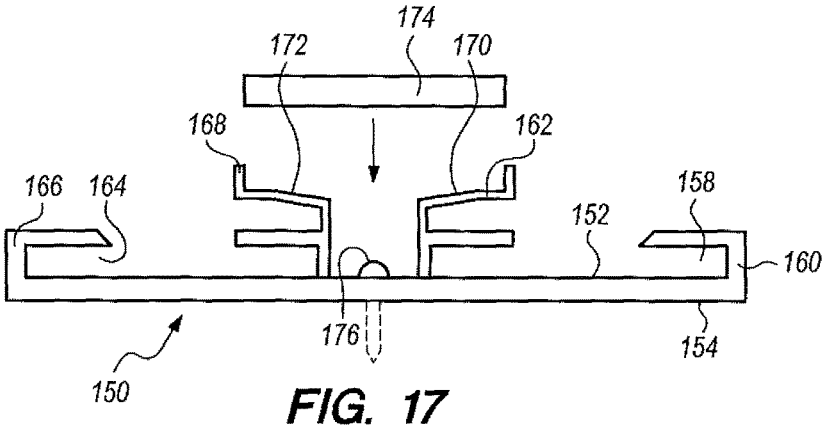
FIG. 17 is a side elevational view of the base member of yet another embodiment of the present application.
Figure 18:
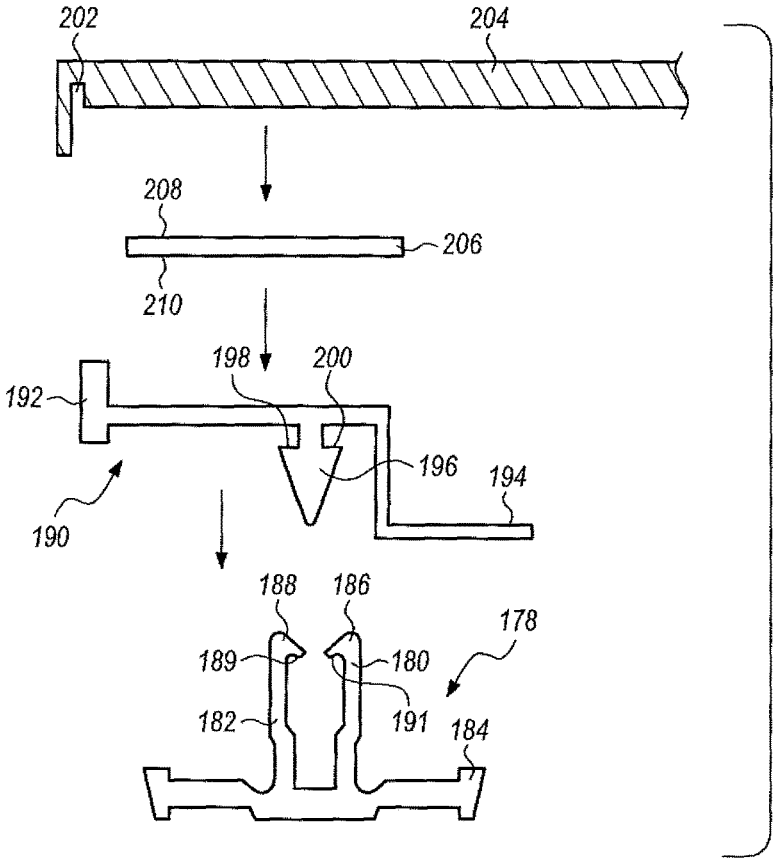
FIG. 18 is an exploded view of the mounting component used with the base member of FIG. 17.
Figure 19:
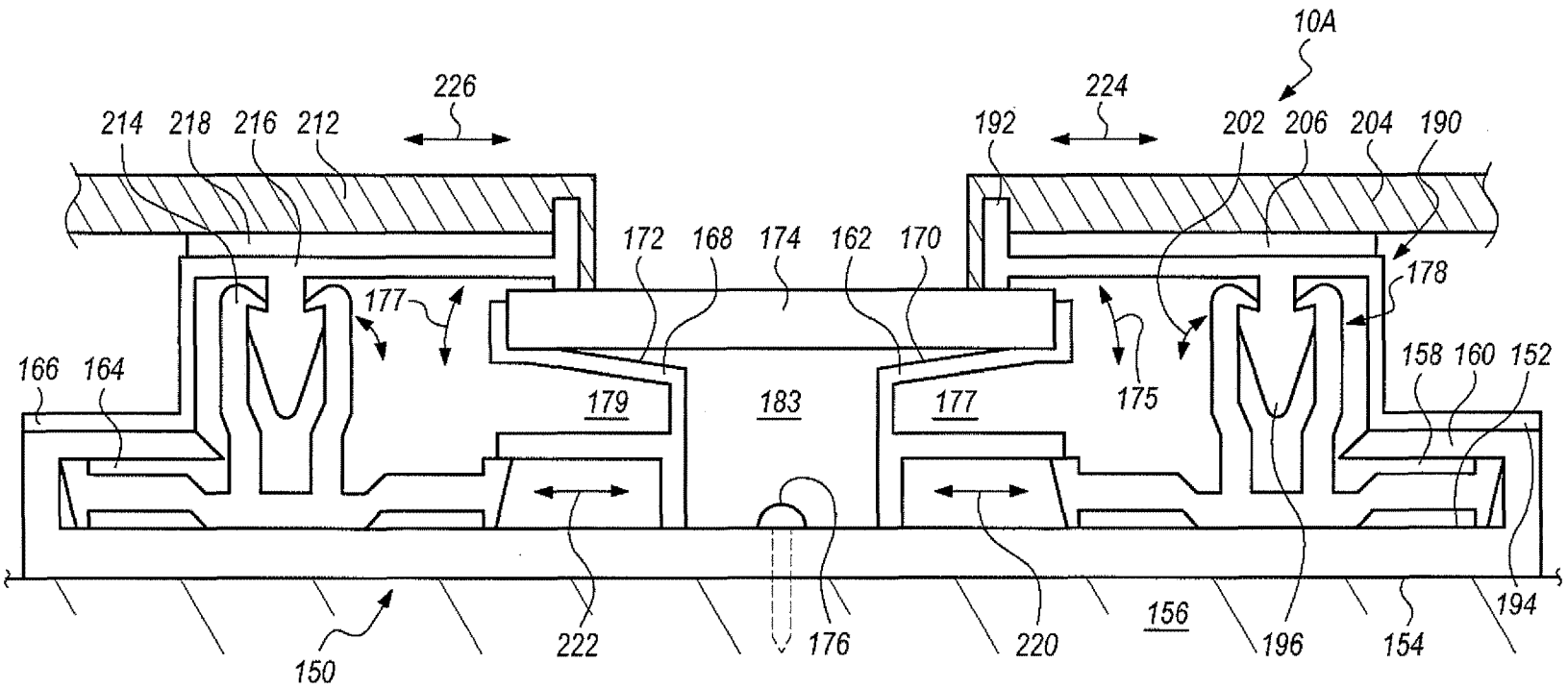
FIG. 19 is a side elevational view of the embodiment of FIGS. 17 and 18 in its assembled condition, mounting a pair of panels.

Looking at FIGS. 17 and 18, it may be seen that a series of components are illustrated with respect to embodiment 10A depicted in FIG. 19 in its assembled condition. With reference to FIG. 17, a base member 150 is depicted. Base member 150 includes a first surface 152 and an opposite second surface 154. Second surface 154 lays adjacent façade 156, FIG. 19. Base member is also formed with a compartment 158 located between wall 160 and a bracket 162. Likewise, a compartment 164 is also constructed as a part of base member 150 and is formed by wall 166 and bracket 168, which is a mirror image of bracket 162. Brackets 162 and 168 create resilient supports 170 and 172 for reveal strip 174. Directional arrows 175 and 177 indicate the resilient characteristics of supports 170 and 172. Compression spaces 179 and 181 beneath supports 170 and 172, respectively, allow resilient deflection or movement of supports 170 and 172. Fastener 176 holds base member 150 to façade 156 within space 183, FIGS. 17 and 19. Multiple fasteners similar to fastener 176 may be employed in space 183.

Returning now to FIG. 18, it may be observed that further components of the mechanism associated with embodiment 10A are shown. Specifically, a receiver 178 is shown. Receiver 178 includes a pair of springy arms 180 and 182 extending from a bottom portion 184. Arms 180 and 182 include end engagement portions 186 and 188. Engagement portions 188 and 186 are in the form of hooks having beveled surfaces 189 and 191, respectively. Also shown on FIG. 18 is an extension member 190. Extension member 190 includes end flange 192 and end shelf 194. In addition, a protrusion 196 projects from extension, member 190 and is formed to fit between arms 180 and 182 of receiver 178. Further, notches 198 and 200 of protrusion 196 are intended to contact and couple with engagement portions 180 and 182 of receiver 178. Since arms 180 and 182 of receiver 178 are springy, protrusion 196 snaps into contact with arms 180 and 182 and are not removable without separation of arms 180 and 182, shown in FIG. 19. Extension member 190 is fixed to panel 204, partially depicted, by the use of holder 206 which may take the form of a tape having mastic layers 208 and 210. It should be noted that a panel 212 is mounted to façade 156 using receiver 214, extension member 216, and holder 218, which are similar to components depicted with respect to the mounting of panel 204. The assemblage of embodiment 10B is depicted in FIG. 19 with respect to panels 204 and 212 being mounted relative to façade 156.

In operation, FIGS. 1-16, panels 26 and 28 are held to façade 22 by the use of apparatus 10 namely by employment of base 12 held to façade 22 and extension elements such as extension elements 54 and 62 of FIG. 7 that are connected to panels 26 and 28 respectively. Base 12 and similar bases serve as a field measuring device for panels installed later. Fastener 34 is pressed down into channel 24 formed between flanges 16 and 18 and twisted or rotated within channel 24 such that contact surfaces 44 and 46 firmly press against platforms 64 and 88 of extension elements 54 and 62, respectively. Such pressing derives from the interaction of inclined surfaces 38 and 39 of fastener 34 against resilient flanges 30 and 32, force arrows 63. Stiffener 95 may be employed in certain cases and may be held by shelf 94 of extension element 62 or shelf 74 of extension element 54 (not shown). A reveal 86 is formed between panels 26 and 28 such that strip 90 positioned within slot 72 and 92 of extension elements 54 and 62, respectively, extends across reveal 86. With respect to use of extension elements such as extension element 96 as shown in FIGS. 8-10, the same operation applies, except that a notch 108 may be used either to support panel 28 or be positioned apart from panel 28. In the latter case, a filler member 110 may be employed in notch 108 as shown in FIG. 10. Again, stiffener 95 may be either held by shelf 102 of extension element 96 or be fastened to the underside of panel 28 by the use of mastic layer 112. Apparatus 10 permits the thermal expansion and contraction of panels 26 and 28 relative to base 12 via the use of fastener 34.

In operation, with respect to embodiment 10A of FIGS. 17-19, base member 150 is affixed to façade 156 via fastener 176 which may be singular or plural. Extension member 178 is fixed to panel 204 via holder 206 while extension member 216 is held to panel 212 via holder 218. Receivers 178 and 214 are placed in compartments 158 and 164 of base member 150, respectively. Extension members 190 and 216 are then snapped into receivers 178 and 214, respectively, via the mechanism discussed heretofore with respect to the components associated with panel 204. That is to say, components associated with panel 204 and panel 212 are similar. Once in place within compartments 158 and 164, receivers 178 and 214 are free to move within such compartments according to directional arrows 220 and 222, FIG. 19. Consequently, such movement is associated with the movement of panels 204 and 212 due to thermal expansion and contraction represented by directional arrows 224 and 226. It should also be noted that panels 204 and 212 are free to move relative to reveal strip 174 in a sliding arrangement. Moreover, extension members 190 and 216 are also able to move in sliding arrangement relative to walls 160 and 166, respectively.

Figure 16:
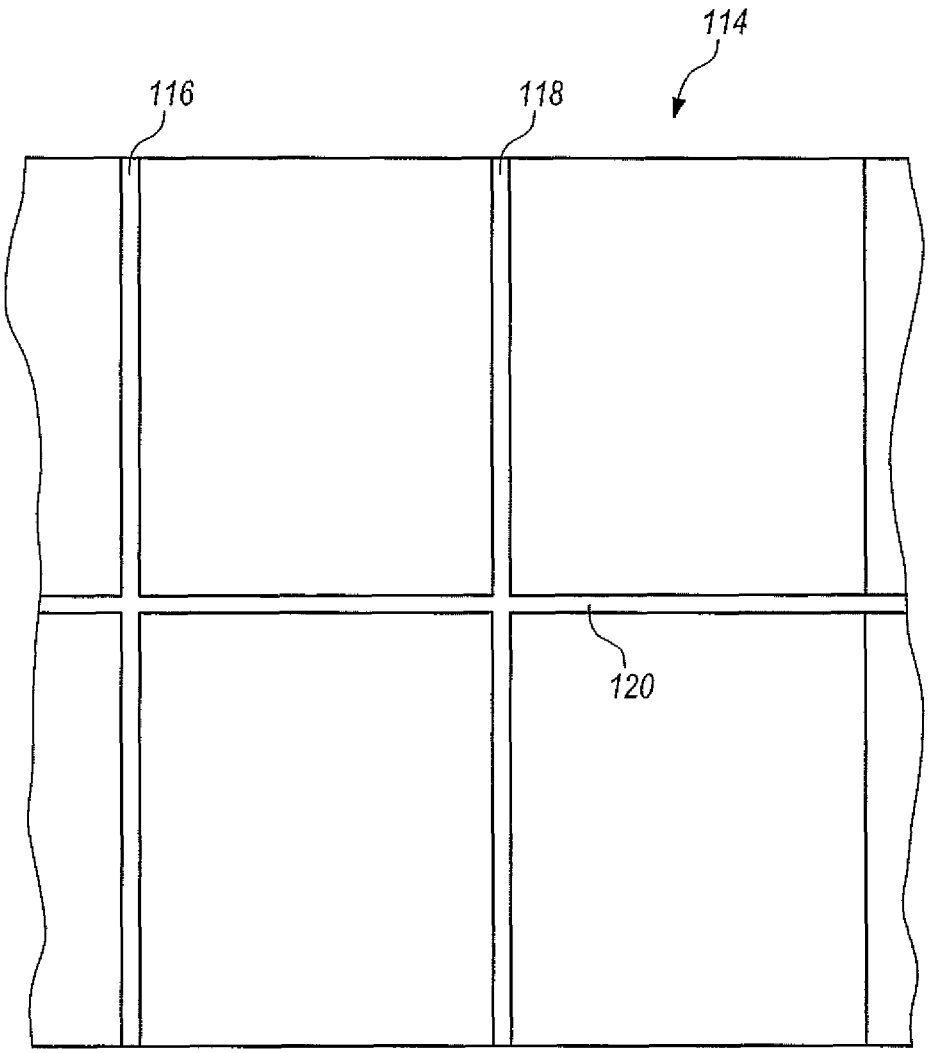
FIG. 16 is a top plan view showing a plurality of panels mounted using the apparatus of the present invention.

FIG. 16 represents a plan view showing a plurality of panels 114 mounted to a façade with reveals 116, 118, and 120 shown therein. Such panels are mounted in a non-progressive manner such that any panel of plurality of panels 114 may be removed as needed by simply by twisting or turning fastener 34 between particular panels to remove the same from the flanges of base members adjacent such plurality of panels.

While in the forgoing embodiments of the present invention have been set forth in considerable detail for the purposes of making a complete disclosure of the invention, it may be apparent to those of skill of the art that numerous changes may be made without departing from the spirit and principles of the invention.

What is claimed is:

1. An apparatus for mounting first and second panels to a facade, comprising:

a base member, said base member including a first surface and a second opposite surface, said base member further comprising first and second compartments, said base member further comprising first and second brackets each spaced from one another and extending outwardly from said first surface of said base member, said first and second brackets forming said first and second compartments, respectively, with said base member;

a first receiver, said first receiver being positioned in said first compartment and further positioned in sliding engagement with said first surface of said base, said receiver comprising an arm oriented outwardly from said first surface of said base member, said arm including an engagement portion;

a second receiver, said second receiver being positioned in said second compartment and further positioned in sliding engagement with said first surface of said base, said receiver comprising an arm oriented outwardly from said first surface of said base member, said arm including an engagement portion;

said first and second receivers being configured for sliding with said first and second compartments upon the thermal expansion and contraction of the first and second panels;

a first extension member, said first extension member comprising a protrusion, said protrusion being configured to couple with said engagement portion of said first receiver for movement therewith;

a second extension member, said second extension member comprising a protrusion, said protrusion being configured to couple with said engagement portion of said second receiver for movement therewith;

a holder for fixing said extension member to the panel;

said first and second brackets further comprising first and second supports; and a strip, said strip positioned on said first and second supports.

2. The apparatus of claim 1 in which said first and second brackets each comprise resilient supports.

3. The apparatus of claim 2 which further comprises first and second compression spaces adjacent first and second supports, respectively.

4. The apparatus of claim 1 in which said holder comprises a mastic coated tape.

5. The apparatus of claim 1 which further comprises a fastener for connecting said base member second surface to the facade.

6. The apparatus of claim 5 in which said fastener comprises a threaded member.

7. The apparatus of claim 1 in which said first receiver arm comprises a first arm, and which said first receiver comprises a second arm, said first and second arms of said first receiver being resiliently linked to said base member, said second arm of said first receiver further comprising an engagement portion, and said first extension member comprising an enlarged portion configured to couple with said engagement portions of said first and second arms of said first receiver.

8. The apparatus of claim 1 in which said engagement portion of said first receiver comprises a hook having a beveled surface.

* * * * *